US007518600B2

(12) United States Patent
Lee

(10) Patent No.: US 7,518,600 B2
(45) Date of Patent: Apr. 14, 2009

(54) CONNECTOR AND APPARATUS OF DRIVING LIQUID CRYSTAL DISPLAY USING THE SAME

(75) Inventor: Jae Hyung Lee, Uiwang-shi (KR)

(73) Assignee: LG Display Co., Ltd., Seoul (KR)

( * ) Notice: Subject to any disclaimer, the term of this patent is extended or adjusted under 35 U.S.C. 154(b) by 457 days.

(21) Appl. No.: 10/682,924

(22) Filed: Oct. 14, 2003

(65) Prior Publication Data

US 2004/0125068 A1 Jul. 1, 2004

(30) Foreign Application Priority Data

Dec. 26, 2002 (KR) ..... 10-2002-0084618

(51) Int. Cl.
*G09G 5/00* (2006.01)

(52) U.S. Cl. ..... 345/204; 345/3.1

(58) Field of Classification Search ..... 345/3.1, 345/87, 501, 519, 520, 204, 214, 589; 710/14, 710/122, 70, 20; 395/500; 370/286; 348/469
See application file for complete search history.

(56) References Cited

U.S. PATENT DOCUMENTS 5,987,543 A * 11/1999 Smith ..... 710/70
6,147,672 A * 11/2000 Shimamoto ..... 345/589
6,232,932 B1 * 5/2001 Thorner ..... 345/1.3
6,263,391 B1 * 7/2001 Pecone et al. ..... 710/313
6,750,856 B2 * 6/2004 Shimamoto ..... 345/204
6,804,724 B2 * 10/2004 Shin ..... 710/2
7,123,248 B1 * 10/2006 Lafleur ..... 345/204

FOREIGN PATENT DOCUMENTS

JP H08-063327 3/1996
KR 10-2002-0000448 A 1/2002
KR 2002-61234 7/2002

OTHER PUBLICATIONS

Korean Office Action dated Feb. 3, 2005.

* cited by examiner

*Primary Examiner*—Kevin M Nguyen
(74) *Attorney, Agent, or Firm*—McKenna Long & Aldridge LLP

(57) ABSTRACT

A liquid crystal display includes a liquid crystal display panel; a drive system for transmitting signals over a predetermined number of channels and for displaying a picture on the liquid crystal display panel; an interface part generating a channel mode signal in accordance with the predetermined number of channels; and a timing controller driven in correspondence with the generated channel mode signal.

14 Claims, 7 Drawing Sheets

FIG.3A
RELATED ART

| PIN | SYMBOL | DESCRIPTION |
|---|---|---|
| 1 | VCC | POWER SUPPLY, 3.3V TYP. |
| 2 | VCC | POWER SUPPLY, 3.3V TYP. |
| 3 | GND | GROUND |
| 4 | GND | GROUND |
| 5 | Rin 0− | NEGATIVE LVDS DIFFERENTIAL DATA INPUT(R0~R5,G0) |
| 6 | Rin 0+ | POSITIVE LVDS DIFFERENTIAL DATA INPUT(R0~R5,G0) |
| 7 | GND | GROUND |
| 8 | Rin 1− | NEGATIVE LVDS DIFFERENTIAL DATA INPUT(G1~G5,B0~B1) |
| 9 | Rin 1+ | POSITIVE LVDS DIFFERENTIAL DATA INPUT(G1~G5,B0~B1) |
| 10 | GND | GROUND |
| 11 | Rin 2− | NEGATIVE LVDS DIFFERENTIAL DATA INPUT(B2~B5,HS,VS,DE) |
| 12 | Rin 2+ | POSITIVE LVDS DIFFERENTIAL DATA INPUT(B2~B5,HS,VS,DE) |
| 13 | GND | GROUND |
| 14 | CLK− | CLOCK− |
| 15 | CLK+ | CLOCK+ |
| 16 | GND | GROUND |
| 17 | NC | RESERVED($V_{EDID}$ FOR SPWG) |
| 18 | NC | RESERVED |
| 19 | GND | GROUND($CLK_{EDID}$ FOR SPWG) |
| 20 | GND | GROUND($DATA_{EDID}$ FOR SPWG) |

FIG.3B
RELATED ART

| PIN | SYMBOL | DESCRIPTION |
|---|---|---|
| 1 | GND | GROUND |
| 2 | VCC | POWER SUPPLY, 3.3V TYP. |
| 3 | VCC | POWER SUPPLY, 3.3V TYP. |
| 4 | NC | RESERVED($V_{EDID}$ FOR SPWG) |
| 5 | NC | RESERVED |
| 6 | NC | RESERVED($CLK_{EDID}$ FOR SPWG) |
| 7 | NC | RESERVED($DATA_{EDID}$ FOR SPWG) |
| 8 | Odd_Rin 0- | NEGATIVE LVDS DIFFERENTIAL DATA INPUT(R0~R5,G0) |
| 9 | Odd_Rin 0+ | POSITIVE LVDS DIFFERENTIAL DATA INPUT(R0~R5,G0) |
| 10 | GND | GROUND |
| 11 | Odd_Rin 1- | NEGATIVE LVDS DIFFERENTIAL DATA INPUT(G1~G5,B0~B1) |
| 12 | Odd_Rin 1+ | POSITIVE LVDS DIFFERENTIAL DATA INPUT(G1~G5,B0~B1) |
| 13 | GND | GROUND |
| 14 | Odd_Rin 2- | NEGATIVE LVDS DIFFERENTIAL DATA INPUT(B2~B5,HS,VS,DE) |
| 15 | Odd_Rin 2+ | POSITIVE LVDS DIFFERENTIAL DATA INPUT(B2~B5,HS,VS,DE) |
| 16 | GND | GROUND |
| 17 | Odd_CLK- | CLOCK- |
| 18 | Odd_CLK+ | CLOCK+ |
| 19 | GND | GROUND |
| 20 | Even_Rin 0- | NEGATIVE LVDS DIFFERENTIAL DATA INPUT(R0~R5,G0) |
| 21 | Even_Rin 0+ | POSITIVE LVDS DIFFERENTIAL DATA INPUT(R0~R5,G0) |
| 22 | GND | GROUND |
| 23 | Even_Rin 1- | NEGATIVE LVDS DIFFERENTIAL DATA INPUT(G1~G5,B0~B1) |
| 24 | Even_Rin 1+ | POSITIVE LVDS DIFFERENTIAL DATA INPUT(G1~G5,B0~B1) |
| 25 | GND | GROUND |
| 26 | Even_Rin 2- | NEGATIVE LVDS DIFFERENTIAL DATA INPUT(B2~B5,HS,VS,DE) |
| 27 | Even_Rin 2+ | POSITIVE LVDS DIFFERENTIAL DATA INPUT(B2~B5,HS,VS,DE) |
| 28 | GND | GROUND |
| 29 | Even_CLK- | CLOCK- |
| 30 | Even_CLK+ | CLOCK+ |

FIG.7

| PIN | SYMBOL | DESCRIPTION |
|---|---|---|
| 1 | MODE | CHANNEL SELECTION |
| 2 | VCC | POWER SUPPLY, 3.3V TYP. |
| 3 | VCC | POWER SUPPLY, 3.3V TYP. |
| 4 | NC | RESERVED($V_{EDID}$ FOR SPWG) |
| 5 | NC | RESERVED |
| 6 | NC | RESERVED($CLK_{EDID}$ FOR SPWG) |
| 7 | NC | RESERVED($DATA_{EDID}$ FOR SPWG) |
| 8 | Odd_Rin 0- | NEGATIVE LVDS DIFFERENTIAL DATA INPUT(R0~R5,G0) |
| 9 | Odd_Rin 0+ | POSITIVE LVDS DIFFERENTIAL DATA INPUT(R0~R5,G0) |
| 10 | GND | GROUND |
| 11 | Odd_Rin 1- | NEGATIVE LVDS DIFFERENTIAL DATA INPUT(G1~G5,B0~B1) |
| 12 | Odd_Rin 1+ | POSITIVE LVDS DIFFERENTIAL DATA INPUT(G1~G5,B0~B1) |
| 13 | GND | GROUND |
| 14 | Odd_Rin 2- | NEGATIVE LVDS DIFFERENTIAL DATA INPUT(B2~B5,HS,VS,DE) |
| 15 | Odd_Rin 2+ | POSITIVE LVDS DIFFERENTIAL DATA INPUT(B2~B5,HS,VS,DE) |
| 16 | GND | GROUND |
| 17 | Odd_CLK- | CLOCK- |
| 18 | Odd_CLK+ | CLOCK+ |
| 19 | GND | GROUND |
| 20 | Even_Rin 0- | NEGATIVE LVDS DIFFERENTIAL DATA INPUT(R0~R5,G0) |
| 21 | Even_Rin 0+ | POSITIVE LVDS DIFFERENTIAL DATA INPUT(R0~R5,G0) |
| 22 | GND | GROUND |
| 23 | Even_Rin 1- | NEGATIVE LVDS DIFFERENTIAL DATA INPUT(G1~G5,B0~B1) |
| 24 | Even_Rin 1+ | POSITIVE LVDS DIFFERENTIAL DATA INPUT(G1~G5,B0~B1) |
| 25 | GND | GROUND |
| 26 | Even_Rin 2- | NEGATIVE LVDS DIFFERENTIAL DATA INPUT(B2~B5,HS,VS,DE) |
| 27 | Even_Rin 2+ | POSITIVE LVDS DIFFERENTIAL DATA INPUT(B2~B5,HS,VS,DE) |
| 28 | GND | GROUND |
| 29 | Even_CLK- | CLOCK- |
| 30 | Even_CLK+ | CLOCK+ |

CONNECTOR AND APPARATUS OF DRIVING LIQUID CRYSTAL DISPLAY USING THE SAME

This application claims the benefit of the Korean Patent Application No. P2002-84618 filed on Dec. 26, 2002, which is hereby incorporated by reference for all purposes as if fully set forth herein.

BACKGROUND OF THE INVENTION

1. Field of the Invention

The present invention relates to liquid crystal displays (LCDs), and more particularly to a connector having an interface part capable of sharing multiple channels and for receiving and transmitting data in accordance with a number of channels determined by a drive system, and a driving apparatus of a liquid crystal display using the same.

2. Description of the Related Art

LCDs are advantageously small in size, thin, and consume low amounts of power and therefore are used extensively in notebook PC's, office automation equipment, audio/video equipment, etc. Active matrix LCDs (AM-LCDs) include switching devices such as TFTs and are capable of displaying moving images.

FIG. 1 illustrates a block diagram of a related art LCD.

Referring to FIG. 1, related art LCDs generally include an LCD panel 6 supporting a plurality of gate lines GL1 to GLm, a plurality of data lines DL1 to DLn crossing the plurality of gate lines, a plurality of TFTs formed at crossings of the gate and data lines for driving corresponding ones of a plurality of liquid crystal cells (Clc) defined by the crossings of the gate and data lines, a data driver 8 for applying data to the data lines DL1 to DLn, a gate driver 10 for applying scan pulses to the gate lines GL1 to GLm, a timing controller 4 for controlling the data and gate drivers 8 and 10, respectively, and an interface part 2 for applying red (R), green (G), and blue (B) digital video data (DATA) and horizontal and vertical synchronization signals (H and V, respectively) to the timing controller 4.

The LCD panel 6 generally includes an upper glass substrates bonded to, and separated from a lower glass substrate, wherein liquid crystal material is injected between the two glass substrates and wherein the plurality of gate and data lines are supported by the lower glass substrate. In response to scan pulses applied to the gate lines GL1 to GLm, the TFTs formed apply video data from the data lines DL1 to DLn to corresponding ones of the liquid crystal cells (Clc). Accordingly, each TFT includes a gate terminal connected to a gate line GL1 to GLm, a source terminal connected to a data line DL1 to DLm, and a drain terminal connected to a pixel electrode (not shown) formed in a corresponding one of the liquid crystal cells (Clc).

The gate driver 10 generally includes a shift register for sequentially generating scan pulses (i.e, gate high pulses) in response to a gate drive control signal (GDC) applied from the timing controller 4 and a level shifter for shifting the voltage of each scan pulse to an appropriate level suitable for driving the liquid crystal cells (Clc). Accordingly, the video data transmitted by the data lines DL is applied to pixel electrodes of liquid crystal cells (Clc) by the TFTs to which the scan pulses are applied.

The data driver 8 receives a data drive control signal (DDC) with digital video data (RGB) from the timing controller 4. The data driver 8 then latches the digital video data (RGB) in synchrony with the data drive control signal (DDC), corrects the latched data in accordance with a gamma voltage Vγ generated by a gamma voltage generator (not shown), converts the corrected data into an analog data, and applies the converted analog data to the data lines DL.

The interface part 2 receives DATA and control signals such as an input clock (DCLK), a horizontal synchronization signal (H), a vertical synchronization signal (V), and a data enable signal (DE) inputted from a drive system such as a personal computer (not shown) and applies the DATA and control signals to the timing controller 4. Generally, the DATA and control signals are transmitted from the drive system to the timing controller 4 using a low voltage differential signal (LVDS) interface and a transistor-transistor logic (TTL). Interface functions can be integrated on the same chip as the timing controller 4.

FIG. 2 illustrates a block diagram of the timing controller and interface part shown in FIG. 1.

Referring to FIG. 2, the interface part 2 generally includes an LVDS transmitter 18 for transmitting various signals applied from the drive system and a first connector 12 for receiving the various signals transmitted from the LVDS transmitter 18 and for transmitting the received various signals to the timing controller 4.

The LVDS transmitter 18 generally receives the control signals and the DATA, provided as R, Q and B color signals having TTL levels applied from the drive system. In accordance with physical properties of the liquid crystal material within the LCD panel, each of the R, G, and B color signals are divided and separately applied to each LVDS transmitter 18 such that R, G, and B color signals having invertable polarities are applied to the LCD panel in accordance with a line inversion driving method or a dot inversion driving method. Further, control signals such as the horizontal synchronization signal (H), the vertical synchronization signal (V) and the data enable signal (DE) are applied to the LVDS transmitter 18. Accordingly, the LVDS transmitter 18 digitizes and compresses the input clock (DCLK), the horizontal synchronization signal (H), the vertical synchronization signal (V), and the data enable (DE) signal, to reduce voltages of the received signals down to the LVDS signal level having voltages of 1V or less. The LVDS signals are transmitted to the timing controller 4 through the first connector 12 and a second connector 14. In other words; signals applied to the LVDS transmitter 18 are converted into LVDS signals having predetermined number of channels that may then be applied to an LVDS receiver 20 built into the timing controller 4 via the first and second connectors 12 and 14, respectively.

Using the horizontal/vertical synchronization signals (H/V), the data enable (DE) signal, and the clock (CLK) outputted by the interface part 2, the timing controller 4 applies the data drive control signals DDC (e.g., a source sampling clock (SSC), a source start pulse (SSP), a source enable signal (SOE), and a polarity control signal (POL)) to the data driver 8 to thereby control the data driver 8. The timing controller 4 also applies gate drive control signals (GDC) (e.g., a gate start pulse (GSP), a gate shift clock (GSC), and a gate output enable (GOE)) to the gate driver 10 to thereby control the gate driver 10.

The timing controller 4 further re-aligns the RGB digital video data outputted by the interface part 2 and applies the re-aligned RGB digital video data to the data driver 8. Accordingly, the LVDS receiver 20 is integrated into the timing controller 4 as an application-specific integrated circuit ASIC to shield the LVDS signals applied from the second connector from electromagnetic interference while restoring the LVDS signals to their original voltage levels. Therefore, the LVDS receiver 20, supplied with the LVDS signals transmitted by the predetermined number of channels, converts the transmitted LVDS signals into a TTL signal.

FIGS. 3A and 3B illustrate the signal arrangement transmittable by pins of the first connector shown in FIG. 2.

Referring to FIG. 3A, signals transmittable by pins of the first connector 12 are confined to a single channel while, in FIG. 3B, signals transmittable by pins of the first connector 12 are confined to two channels. Accordingly, the arrangement of signals that must be transmitted by the pins of the first connector are different depending upon whether signals transmitted by the drive system are transmitted over a single channel or over a double channel. Therefore, the first connector 12 shown in FIG. 3A can only be used if a single channel is used to receive signals from the drive system whereas the first connector 12 shown in FIG. 3B is used if two channels are used to the channels receive signals from the drive system. If, however, only one channel is provided for receiving signals from the drive system but use of the first connector 12 having two channels is desired, the LCD must be disadvantageously re-designed and re-developed to incorporate an entirely new chip set and new electromagnetic shielding even though the components of the LCD panel itself remain the same.

SUMMARY OF THE INVENTION

Accordingly, the present invention is directed to a connector and apparatus of driving a liquid crystal display using the same that substantially obviates one or more of the problems due to limitations and disadvantages of the related art.

An advantage of the present invention provides a connector having an interface part capable of sharing multiple channels and for receiving and transmitting data in accordance with a number of channels determined by a drive system, and a driving apparatus of a liquid crystal display using the same.

Additional features and advantages of the invention will be set forth in the description which follows, and in part will be apparent from the description, or may be learned by practice of the invention. These and other advantages of the invention will be realized and attained by the structure particularly pointed out in the written description and claims hereof as well as the appended drawings.

To achieve these and other advantages and in accordance with the purpose of the present invention, as embodied and broadly described, a liquid crystal display may, for example, include a liquid crystal display panel; a drive system for transmitting signals over a predetermined number of channels and for displaying a picture on the liquid crystal display panel; an interface part generating a channel mode signal having the predetermined channel type that indicates one of a single channel and a double channel; and a timing controller driven in correspondence with the generated channel mode signal.

In one aspect of the present invention, the interface part may, for example, include a low voltage differential signal transmitter for transmitting a low voltage differential signal in correspondence with the signal transmitted by the drive system; and a first connector for receiving the low voltage differential signal transmitted from the low voltage differential signal transmitter and for transmitting the received plurality of low voltage differential signal to the timing controller.

In another aspect of the present invention, the first connector may, for example, include a channel mode terminal for outputting the channel mode signal having the predetermined channel type that indicates one of a single channel and a double channel.

In still another aspect of the present invention, the timing controller may, for example, include a second connector for receiving the low voltage differential signal transmitted from the first connector and for transmitting the received low voltage differential signal; and a low voltage differential signal receiver for receiving the low voltage differential signal transmitted from the second connector.

In yet another aspect of the present invention, the second connector may include a channel mode-receiving terminal for receiving the channel mode signal outputted from the first connector.

In yet a further aspect of the present invention, the channel mode signal, to which the timing controller is driven in correspondence with has, n channels where $n \geqq 1$, is outputted from the drive system, and includes data and control signals corresponding to the n channels generated from the interface part.

In still a further aspect of the present invention, the predetermined number of channels includes single channel.

In one aspect of the present invention, the interface part may generate a high logic channel mode signal.

In another aspect of the present invention, the predetermined number of channels includes two channels.

In still another aspect of the present invention, the interface part may generate a low logic channel mode signal.

In accordance with the principles of another aspect of the present invention, a connector may be provided for receiving signals, transmittable over a predetermined number of channels, and for generating a signal in accordance with the predetermined number of channels, wherein the connector includes pins for transmitting the received signals, wherein an arrangement of signals transmittable by the pins corresponds with the predetermined number of channels.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings:

FIGS. 3A and 3B illustrate the signal arrangement transmittable by pins of the first connector shown in FIG. 2;

FIG. 7 illustrates the signal arrangement transmittable by pins of the first connector shown in FIG. 6.

DETAILED DESCRIPTION OF THE ILLUSTRATED EMBODIMENTS

Reference will now be made in detail to embodiments of the present invention, examples of which are illustrated in the accompanying drawings.

Figure 1:
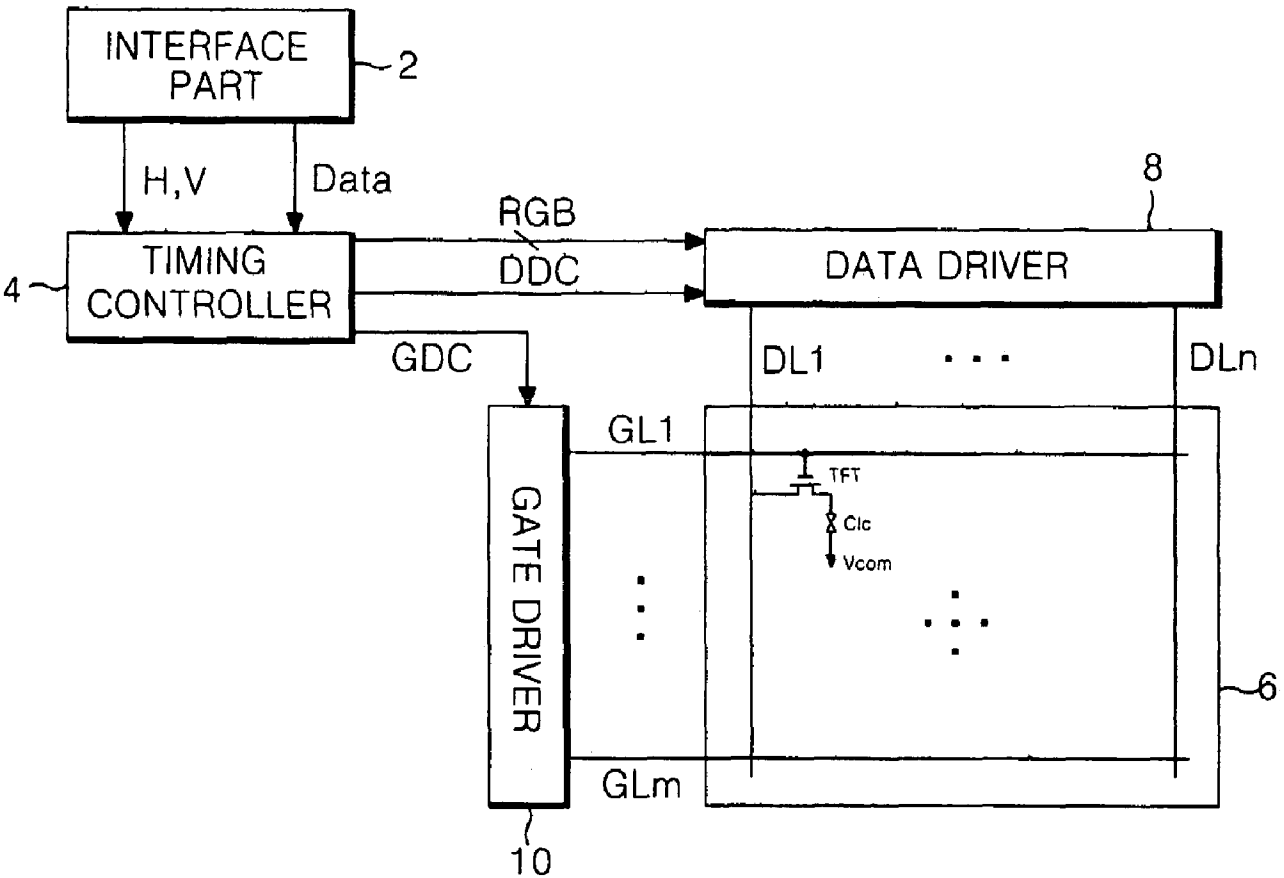
FIG. 1 RELATED ART
FIG. 1 illustrates a block diagram of a related art LCD.
Figure 2:
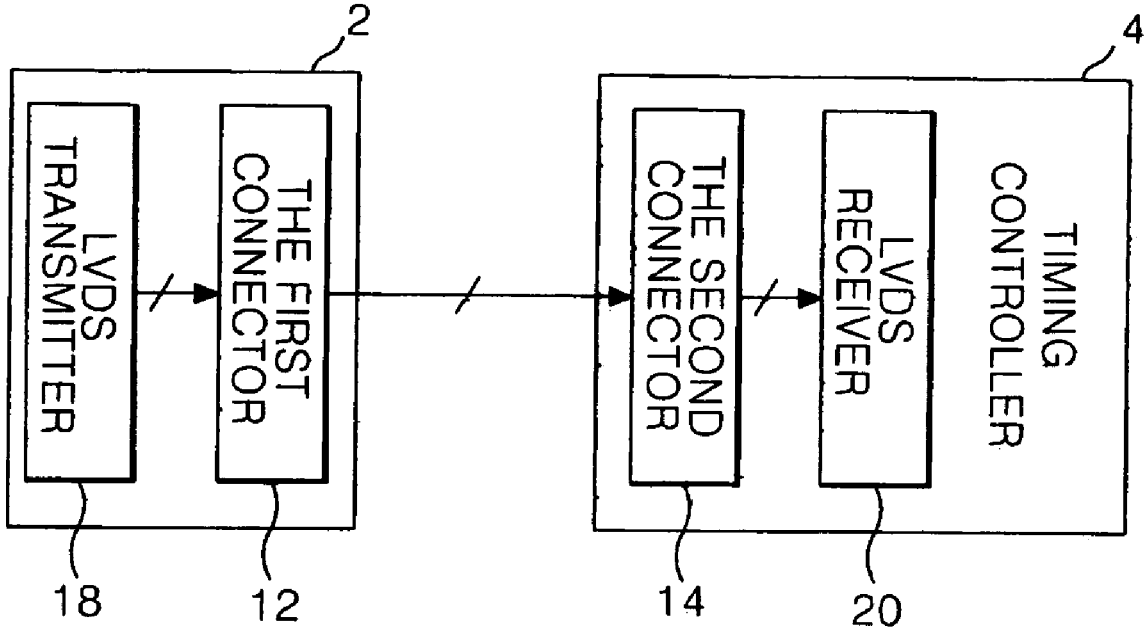
FIG. 2 RELATED ART
FIG. 2 illustrates a block diagram of the timing controller and interface shown in FIG. 1.
Figure 4:
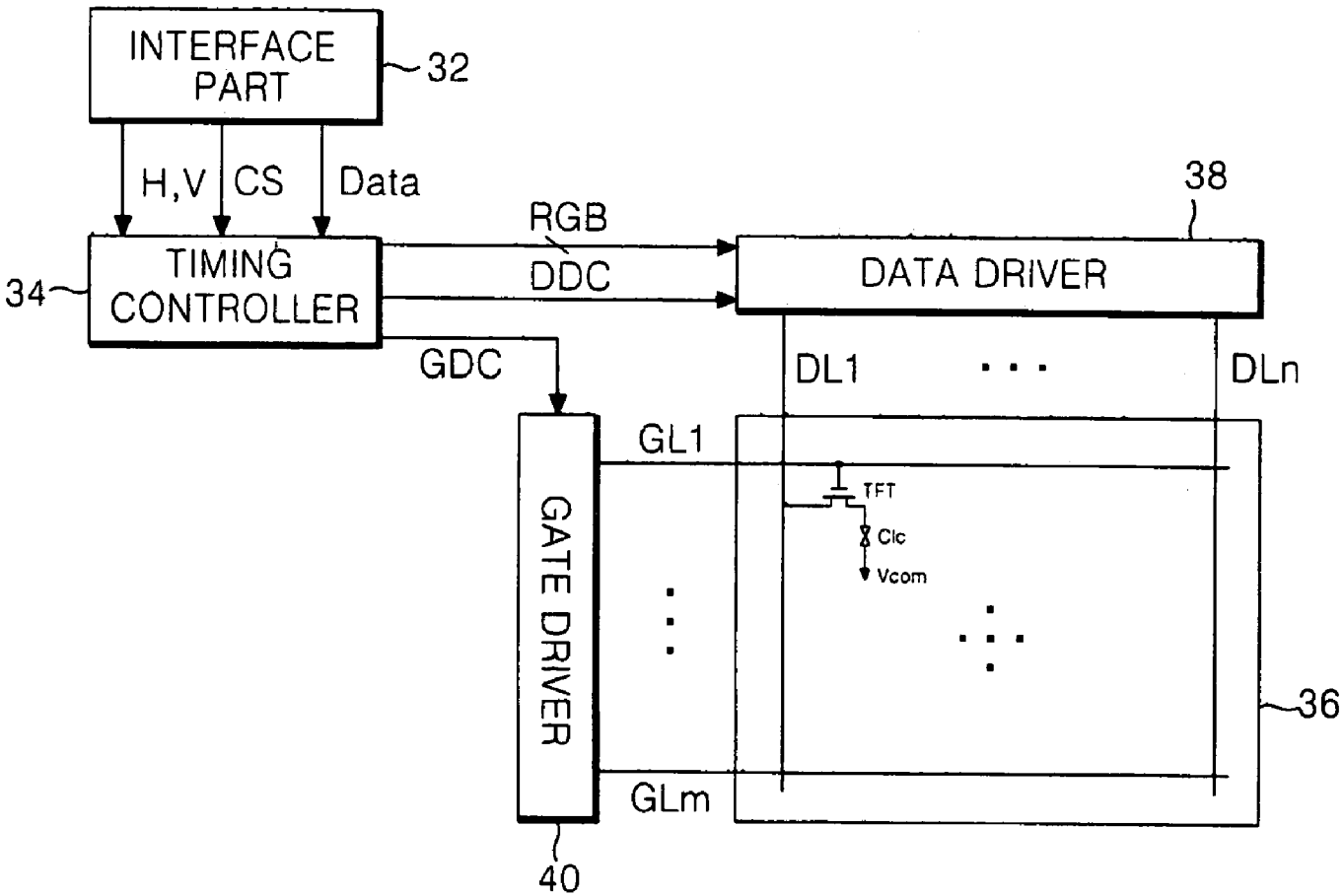
FIG. 4 illustrates a block diagram of an LCD in accordance with the principles of the present invention.

FIG. 4 illustrates a block diagram of an LCD in accordance with the principles of the present invention.

Referring to FIG. 4, an. LCD of the present invention may, for example, include an LCD panel 36 having a plurality of gate lines GL1 to GLm, a plurality of data lines DL1 to DLn crossing the plurality of gate lines, a plurality of switching devices (e.g., TFTs formed at crossings of the gate lines and data lines) may be provided for driving corresponding ones of a plurality of liquid crystal cells (Clc) defined by the crossings of the gate and data lines, a data driver 38 for applying data to the plurality of data lines DL1 to DLn, a gate driver 40 for applying scan pulses to the plurality of gate lines GL1 to GLm, a timing controller 34 for controlling the data driver 38 and the gate driver 40, and an interface part 32 for applying RGB digital video data (DATA) and horizontal and vertical synchronization signals (H and V, respectively) to the timing controller 34.

The LCD panel 36 may include an upper glass substrate bonded to, and separated from a lower glass substrate, wherein liquid crystal material may be injected between two glass substrates and wherein the gate and data lines may be formed on the lower glass substrate. In response to scan pulses applied to the gate lines GL1 to Glm, the TFTs formed may apply video data from the data lines DL1 to DLn to corresponding ones of the liquid crystal cells (Clc). Accordingly, each TFT may, for example, include a gate terminal connected to a gate line GL1 to GLm, a source terminal connected to a data line DL1 to DLm, and a drain tenrmal connected to a pixel electrode (not shown) formed in a corresponding one of the liquid crystal cells (Clc).

The gate driver 40 may, for example, include a shift register for sequentially generating scan pulses (e.g., gate high pulses) in response to a gate drive control signal (GDC) applied from the timing controller 34 and a level shifter for shifting a voltage of the scan pulses to an appropriate level suitable for driving the liquid crystal cells (Clc). Accordingly, the video data transmitted by the data lines DL may be applied to pixel electrodes (not shown) of liquid crystal cells (Clc) by the TFTs to which the scan pulse are applied.

The data driver 38 may receive a dot clock (Dclk) with RGB digital video data from the timing controller 34. The data driver 38 may then latch the RGB digital video data in synchrony with the dot clock (Dclk), correct the latched data in accordance with a gamma voltage Vγ generated by a gamma voltage generator (not shown), convert the corrected data into analog data, and apply the converted analog data to the data line DL.

The interface part 32 may receive RGB data signals (DATA) and control signals such as an input clock (DCLK), a horizontal synchronization signal (H), a vertical synchronization signal (V), and a data enable signal (DE) inputted from a drive system (not shown) such as a personal computer and may apply the received RGB data and the control signals to the timing controller 34. In one aspect of the present invention, the RGB data and control signals may be transmitted to the interface part 32 over a predetermined channel type that indicates one of a single channel and a double channel. In another aspect of the present invention, the received RGB data and control signals may be transmitted from the drive system to the timing controller 34 using a low voltage differential signal (LVDS) interface and a transistor-transistor logic (TTL), as will be described in greater detail below. In yet another aspect of the present invention, interface functions may be integrated on the same chip as the timing controller 34.

Figure 5:
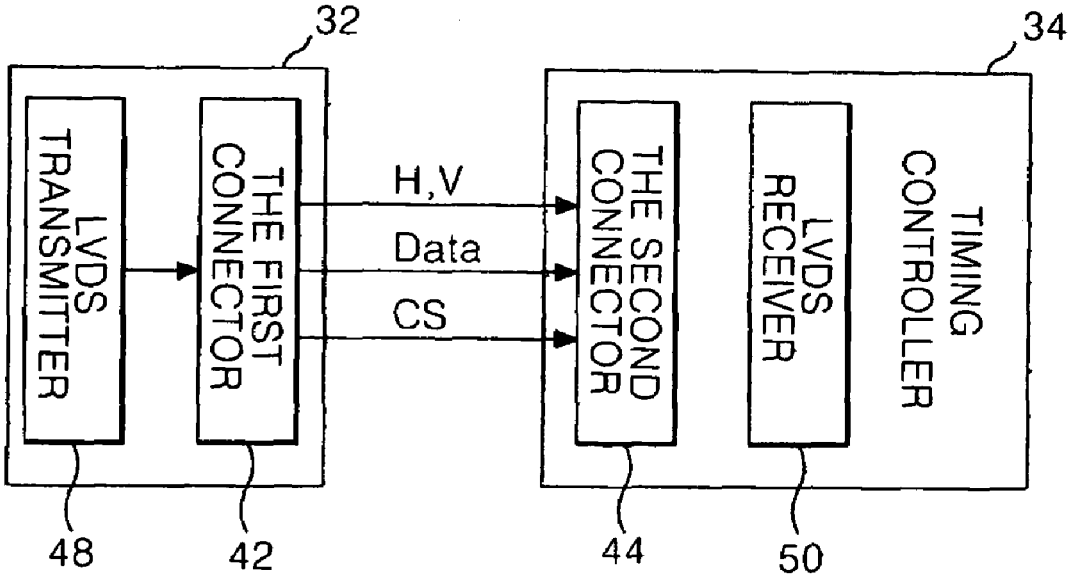
FIG. 5 illustrates a block diagram of the timing controller and interface part shown in FIG. 4.

FIG. 5 illustrates a block diagram of the timing controller and interface part shown in FIG. 4.

Referring to FIG. 5, the interface part 32 may, for example, include an LVDS transmitter 48 for transmitting various signals applied from the drive system and a first connector 42 for receiving the various signals transmitted from the LVDS transmitter 38 and for transmitting the received various signals to the timing controller 34.

The LVDS transmitter 48 may receive the RGB data and the control signals having TTL levels applied from the drive system. Due to the physical properties of the liquid crystal material within the LCD panel 36, the RGB data may be divided and separately applied to each LVDS transmitter 48 such that R, Q and B data signals having invertable polarities may be applied to the LCD panel 36 in accordance with a line inversion or a dot inversion driving method. Further, the control signals (e.g., the horizontal synchronization signal (H), the vertical synchronization signal (V), the data enable signal (DE), etc.) may be applied to the LVDS transmitter 48. Accordingly, the LVDS transmitter 48 may digitize and compress the input clock (DCLK), the horizontal synchronization signal (H), the vertical synchronization signal (V), and the data enable (DE) signal and reduce voltage of the received signals down to the LVDS signal level of about 1V or less. In one aspect of the present invention, the LVDS signals may be transmitted to the timing controller 34 via the first connector 42 and a second connector 44. Accordingly, each signal applied to the LVDS transmitter 48 may be converted into an LVDS signal having the predetermined channel type and may then be applied to an LVDS receiver 50 built into the timing controller 34 via the first and second connectors 42 and 44, respectively.

Figure 6:
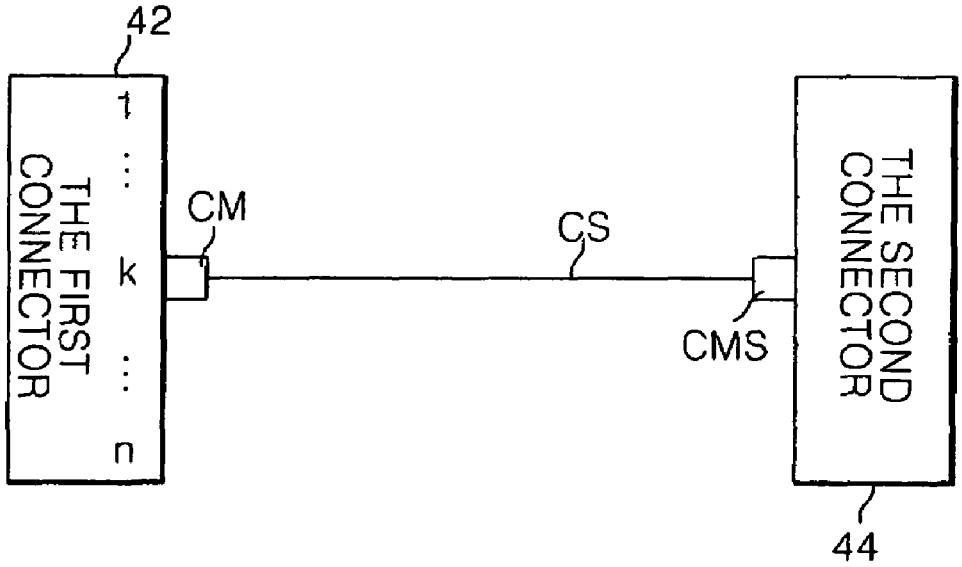
FIG. 6 illustrates a block diagram of the first connector and the second connector shown in FIG. 5.

FIG. 6 illustrates a block diagram of the first connector and the second connector shown in FIG. 5.

Referring to FIG. 6, the first connector 42 may, for example, apply the transmitted LVDS signal, outputted from the LVDS transmitter 48, to the LVDS receiver 50 via the second connector 44. In one aspect of the present invention, a signal arrangement transmittable by pins of the first connector 42 may be altered in accordance with the channel type the LVDS signal is being transmitted over. In another aspect of the present invention, a $k^{th}$ terminal (where $1<k<n$) of the first connector 42 may be provided as a channel mode terminal (CM), transmitting a channel mode signal (CS) having the predetermined channel type. The channel mode signal (CS) has a channel type that indicates one of a single channel and a double channel. Accordingly, the channel mode terminal (CM) may be any terminal within a predetermined range of terminals, regardless of its pin number. Further, two or more terminals may be provided as channel mode terminals (CM).

Using the horizontal/vertical synchronization signals (H/V), the data enable (DE) signal, the clock (CLK) outputted by the interface part 32, the timing controller 34 may, in one aspect of the present invention, apply data drive control signals (DDC) (e.g., a source sampling clock (SSC), a source start pulse (SSP), a source enable signal (SOE), a polarity control signal (POL), etc.) to the data driver 38 to control the data driver 38. In another aspect of the present invention, the timing controller 34 may also apply gate drive control signals (GDC) (e.g., a gate start pulse (GSP), a gate shift clock (GSC), a gate output enable (GOE), etc.) to the gate driver 40 to control the gate driver 40. In yet another aspect of the present invention, the timing controller 34 may re-align the RGB digital video data (DATA) outputted by the interface part 32 and applies the re-aligned RGB digital video data to the data driver 38. Therefore, and in accordance with the principles of the present invention, the timing controller 34 may include an LVDS receiver 50 provided as an application-specific integrated circuit (ASIC) and the second connector 44 for applying the transmitted LVDS signal to the LVDS receiver 50.

In one aspect of the present invention, the second connector 44 may be provided with a channel mode receiving terminal (CMS) for receiving an channel mode signal (CS) transmitted from the channel mode terminal (CM) of the first connector 42. The channel mode receiving terminal (CMS) may determine the channel type a signal is being transmitted by, based on the channel mode signal (CS) transmitted from the channel mode terminal (CM). Upon receiving the output signal (CS), the LVDS receiver 50 may select the channel type determined at the second connector 44. The LVDS receiver 50 may shield the LVDS signals applied from the second connector 42 from electromagnetic interference while restoring the received LVDS signal to its original voltage level in accordance with the selected channel type.

As mentioned above, the signal arrangement transmittable by pins of the first connector 42 may be altered in accordance with the channel type the LVDS signal is being transmitted over. In one aspect of the present invention, the first connector 42 may be capable of transmitting the LVDS signal over a single channel. In another aspect of the present invention, the first connector 42 may be capable of transmitting the LVDS signal over a double channel.

FIG. 7 illustrates the signal arrangement transmittable by pins of the first connector shown in FIG. 6.

Referring to FIG. 7, the first terminal of the first connector 42 may, for example, be provided as the channel mode terminal (CM). Accordingly, when a single channel is selected by the drive system (not shown), the channel mode terminal (CM) of the first connector 42 of the interface part 32 may apply the channel mode signal (CS) having, for example, a high logic voltage value to the channel mode receiving terminal (CMS) of the second connector 44. Accordingly, the single channel data and clock signals, together with the high logic channel mode signal (CS), may be applied to the second connector 44. Therefore, signals may be transmitted from the first to nineteenth terminals of the first connector 42 to the second connector 44 while signals may not be transmitted from the twentieth to thirtieth terminals of the first connector 42 to the second connector 44. The LVDS receiver 50 restores the received LVDS signal to the original voltage level while maintaining the single channel of the signal, in accordance with the high logic channel mode signal (CS) applied to the second connector 44.

When a double channel is selected by the drive system, the channel mode terminal (CM) of the first connector 42 may apply the channel mode signal (CS) having, for example, a low logic voltage value to the channel mode receiving terminal (CMS) of the second connector 44. Accordingly, the double channel data and clock signals, together with the low logic channel mode signal (CS), may be applied to the second connector 44. Therefore, signals may be transmitted from the first to thirtieth terminals of the first connector 42 to the second connector 44 and the LVDS receiver 50 may restore the received LVDS signal to the original voltage level while maintaining the double channel of the signal, in accordance with the low logic channel mode signal (CS) applied to the second connector 44.

The connector and the LCD driving apparatus using the connector, in accordance with the principles of the present invention, allow a channel mode to be selected. A channel mode may therefore be selected by a first connector within an interface part of an LCD and the LCD may be drive in accordance with the selected channel mode. Accordingly, the first connector can receive a signal transmitted over n channels (where $n \geqq 1$) and transmit a corresponding channel mode signal to a second connector within a timing controller of the LCD. The second connector may then sense a voltage level of the received channel mode signal to determine the channel type a signal is being transmitted over. Therefore, the first connector can transmit signals over one or more channels while driving the same LCD panel. Accordingly, it is not necessary to re-design and re-develop an LCD panel when the channel type a driving signals are being transmitted over to the interface part changes. Moreover, the same LCD panel can be used with diverse drive systems.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their-equivalents.

What is claimed is:

1. A driving apparatus of a liquid crystal display, comprising:

a liquid crystal display (LCD) panel;

a drive system for setting a channel type that indicates one of a single channel and a double channel and transmitting a plurality of signals having TTL levels to drive the LCD panel;

an interface part that generates a channel mode signal having the channel type and converts the plurality of signals having TTL levels into a plurality of low voltage differential signals in accordance with the channel type, the interface part including a first connector for outputting the low voltage differential signals and the channel mode signal having the channel type; and a timing controller that receives the low voltage differential signals and the channel mode signal having the channel type through a second connector, converts the low voltage differential signals into a plurality of transistor-transistor logic (TTL) signals in accordance with the channel type of the channel mode signal, and transmits the plurality of TTL signals to gate and data drivers of the LCD panel, wherein an arrangement of the LVDS signals transmittable by pins of the first connector is altered in accordance with the channel type.

2. The driving apparatus according to claim 1, wherein the interface part further includes:

a low voltage differential signal transmitter for converting the plurality of signals into the plurality of low voltage differential signals transmitted by the drive system.

3. The driving apparatus according to claim 2, wherein the timing controller includes:

the second connector for receiving the plurality of low voltage differential signals and the channel mode signal transmitted from the first connector; and a low voltage differential signal receiver for converting the low voltage differential signals into the plurality of transistor-transistor logic (TTL) signals in accordance with the channel type of the channel mode signal transmitted from the second connector.

4. The driving apparatus according to claim 3, wherein the second connector includes a channel mode receiving terminal for receiving the channel mode signal outputted from the first connector.

5. The driving apparatus according to claim 1, wherein the first connector includes a channel mode terminal for outputting the channel mode signal.

6. The driving apparatus according to claim 1, wherein the plurality of signals includes data signals and control signals for driving the LCD panel.

7. The driving apparatus according to claim 1, wherein the plurality of signals correspond to a single channel driving method.

8. The driving apparatus according to claim 7, wherein the channel mode signal has a high logic voltage value.

9. The driving apparatus according to claim 1, wherein the plurality of signals correspond to a double channel driving method.

10. The driving apparatus according to claim 9, wherein the channel mode signal has a low logic voltage value.

11. A method of driving a display device, comprising: generating a channel mode signal having a channel type that indicates one of a single channel and a double channel;

converting a plurality of signals having TTL levels for driving a display panel into a plurality of low voltage differential signals;

outputting the low voltage differential signals and the channel mode signal having the channel type through a first connector;

receiving the low voltage differential signals and the channel mode signal having the channel type through a second connector;

converting the low voltage differential signals into a plurality of transistor-transistor logic (TTL) signals in accordance with the channel type of the channel mode signal; and transmitting the plurality of TTL signals to gate and data drivers of the display panel, wherein an arrangement of the LVDS signals transmittable by pins of the first connector is altered in accordance with the channel type.

12. The method of claim 11, wherein the display device comprises a liquid crystal display device.

13. The method of claim 11, further comprising reducing a voltage level of the received plurality of signals.

14. The method of claim 13, wherein the reduced voltage level of the plurality of signals is increased before being transmitted to the gate and data drivers of the display device.

* * * * *